US006459227B2

(12) United States Patent
Barr

(10) Patent No.: US 6,459,227 B2
(45) Date of Patent: Oct. 1, 2002

(54) SERVO-ARTICULATED MODULES AND ROBOTIC ASSEMBLIES INCORPORATING THEM

(76) Inventor: Steven Barr, 57 Newport Dr., Manalapan, NJ (US) 07726

( * ) Notice: Subject to any disclaimer, the term of this patent is extended or adjusted under 35 U.S.C. 154(b) by 20 days.

(21) Appl. No.: 09/770,976

(22) Filed: Jan. 26, 2001

Related U.S. Application Data

(62) Division of application No. 09/294,582, filed on Apr. 20, 1999, now Pat. No. 6,198,247.

(51) Int. Cl.[7] ..... G09F 19/00

(52) U.S. Cl. ..... 318/568.1; 40/414; 403/53; 712/220

(58) Field of Search ..... 318/560, 567, 318/568.1, 568.11; 40/414, 418, 419, 420; 403/52, 53, 54; 712/220, 223, 225

(56) References Cited

U.S. PATENT DOCUMENTS 3,543,910 A * 12/1970 Devol et al.
3,767,901 A * 10/1973 Black et al.
3,792,243 A * 2/1974 Appel et al.
3,898,438 A * 8/1975 Nater et al.
3,912,694 A * 10/1975 Chiappe et al.
4,352,620 A * 10/1982 Inaba et al. ..... 414/225
4,775,352 A * 10/1988 Curran et al.
4,805,328 A * 2/1989 Mirahem
4,825,136 A * 4/1989 Farhat ..... 318/568.1
4,899,637 A * 2/1990 Caruso ..... 91/173
5,013,276 A * 5/1991 Garfinkel ..... 446/14
5,142,803 A * 9/1992 Lang ..... 40/411
5,270,480 A * 12/1993 Hikawa ..... 84/645
5,289,273 A * 2/1994 Lang ..... 318/565 X
5,394,766 A * 3/1995 Johnson et al. ..... 74/490.01
5,493,185 A * 2/1996 Mohr et al. ..... 318/3
5,603,177 A * 2/1997 Saunders ..... 40/418
5,623,428 A * 4/1997 Kunii et al. ..... 364/578
5,655,945 A * 8/1997 Jani ..... 446/175
5,696,892 A * 12/1997 Redmann et al. ..... 395/125
5,800,567 A * 9/1998 Cooper et al. ..... 623/39
5,940,167 A * 8/1999 Gans ..... 352/43
6,067,096 A * 5/2000 Nagle ..... 345/473

* cited by examiner

*Primary Examiner*—Bentsu Ro
(74) *Attorney, Agent, or Firm*—Milde & Hoffberg, LLP

(57) ABSTRACT

A doubly articulated module for attaching a first portion of a robotic assembly to a second portion of said assembly, said first portion being rotatable with respect to said second portion about a first axis substantially perpendicular to a first axis of the first portion and about a second axis substantially coaxial with said first axis. Preferably, the articulated module comprises servos. Several of the modules can be incorporated into arms, legs, torso, neck and head of a mannequin in order to animate as much of the mannequin as is required. Although the servos can be activated by directly wired controls or by remote radio-controlled devices, a preferred programmed system is provided for the computerized control of the modules so that the mannequin can be used for display or demonstration purposes.

6 Claims, 8 Drawing Sheets

SERVO-ARTICULATED MODULES AND ROBOTIC ASSEMBLIES INCORPORATING THEM

CROSS-REFERENCE TO RELATED APPLICATION

This application is a divisional application of U.S. patent application Ser. No. 09/294,582, filed Apr. 20, 1999, now U.S. Pat. No. 6,198,247.

The invention relates to articulated modules and robotic assemblies incorporating them, particularly mannequins used for displays and demonstrations. Preferably, the modules are servo-articulated.

BACKGROUND OF THE INVENTION

U.S. Pat. No. 3,767,901 discloses a digital animation graphics apparatus and methods. This appears to be the basic patent in the prior art since 1975.

U.S. Pat. No. 3,898,438 discloses a programmable method for digital animation apparatus for assembling animation data.

U.S. Pat. No. 3,912,694 discloses mechanical dolls which are controlled by signals on a recording medium. Over the prior art, this patent has achieved synchronizing at reduced cost.

U.S. Pat. No. 4,825,136 describes a mimetic function simulator. This patent addresses the "adequate number of control devices" limitation of prior art. It also addresses the complexity, space, and size of prior methods of controlling facial muscles. Control methods are broad, using tape recorder, keyboard, and modem.

U.S. Pat. No. 5,013,276 describes the use of thermal motors (composed of Nitinol). However, motion is simple and random. This invention described in this patent is not directly programmable, nor does it use a large number of degrees of freedom.

U.S. Pat. No. 5,270,480 describes a toy acting in response to a Midi signal. This invention is about the conversion of an instrument playing signals into drive signals.

U.S. Pat. Nos. 5,289,273 and 5,142,803 disclose an animated character system with real-time control. This patent has a complex implementation, but it does mention "direct drive vs indirect drive" as a method of controlling joints. One example is the direct drive control at the shoulder (FIGS. 10*a*, 10*b*), and also for the head (FIG. 8*a*), and for the wrist. Additionally, it mentions the use of surgical tubing as a way to counteract gravity.

U.S. Pat. No. 5,394,766 describes a robotic human torso that takes advantage of hydraulic rotary actuators, and also linear actuators. The improvement over the prior art is in the size and number of degrees of freedom that can be implemented. This patent describes an industrial implementation. What the present invention accomplishes over this patent is that it Uses conventional and readily (commercially) available parts, and is Simpler and Cheaper.

U.S. Pat. No. 5,493,185 discloses a method for animating motor driven puppets and the like and apparatus implementing the method. This patent mentions prior art as unsuited to effectively process the control signals.

U.S. Pat. No. 5,623,428 describes a method for developing computer animation that covers the underlying technology in modern computer animation: forward kinematics and reverse kinematics.

U.S. Pat. No. 5,655,945 describes a video and radio-controlled moving and talking device. This references signals carried on VCR and TV and an expanded use of the invention specifically referred to as "custom skeletal structure" linkages, a plurality of electric motors. The reference describes the use of a computer to integrate sound waves to send responses to a transmitter.

U.S. Pat. No. 5,696,892 describes a method and apparatus for providing animation in a three dimensional computer generated virtual world using a succession of textures derived from temporarily related source images. This reflects the state of the art in how some of the computer animation today gets accomplished. Claims are for incorporating real world objects into 3D computer graphics.

SUMMARY OF THE INVENTION

It is an object of this invention to provide a simple articulated module for the joints of a mannequin.

It is an object of this invention to provide a simple servo-articulated module for the joints of an animated mannequin.

It is an object of this invention to provide an inexpensive servo-articulated module for the joints of an animated mannequin.

It is an object of this invention to provide a method for preparing a choreograph that can be used by those skilled in computer applications for activating the joints of a mannequin.

It is an object of this invention to provide a simple method for computer control of a choreograph for activating the joints of a mannequin.

These objects and others that will become apparent from the following specification are achieved by a servo-articulated module having doubly articulated means for attaching a first portion of a robotic assembly to a second portion of said assembly, said first portion being rotatable with respect to said second portion about a first axis substantially perpendicular to a first axis of the first portion and about a second axis substantially coaxial with said first axis These objects are further achieved by a robot arm, adapted to be arranged on a torso of a human mannequin figure, which stimulates the movements of a human arm, the torso having a central longitudinal torso axis and the arm having a central longitudinal arm axis which in the extended position, comprising in combination:

(a) a shoulder portion having articulated means for attaching the arm to the torso, the arm being rotatable with respect to the torso about a shoulder axis substantially perpendicular to the central torso axis;

(b) an upper arm portion having doubly articulated means for attaching the upper arm portion to the shoulder portion, the upper arm portion being rotatable with respect to the shoulder portion about a first axis substantially perpendicular to the central arm axis and about a second axis substantially coaxial with the central arm axis;

(c) a forearm portion having double articulated means for attaching the forearm portion to the upper arm portion, the forearm portion being rotatable with respect to the upper arm portion about a third axis substantially perpendicular to the central arm axis and about a fourth axis substantially coaxial with the central arm axis; and (d) a hand portion having articulated means for attaching the hand portion to the forearm portion, the hand portion being rotatable with respect to the forearm portion about a fifth axis substantially perpendicular to the central arm axis.

The articulated means of the hand portion may be doubly articulated and the hand portion may be further rotatable with respect to the forearm portion about a sixth axis which is substantially perpendicular to the central arm axis and to the fifth axis.

In addition, the invention provides a robot leg, adapted to be arranged on a torso of a human mannequin figure, which simulates the movements of a human leg, the torso having a central longitudinal torso axis and the leg having a central longitudinal leg axis when in the extended position, comprising in combination:

(a) a hip portion having articulated means for attaching the leg to the torso, the leg being rotatable with respect to the torso about a hip axis substantially perpendicular to the central torso axis;

(b) an upper leg portion having doubly articulated means for attaching the upper leg portion to the hip portion, the upper leg portion being rotatable with respect to the hip portion about a first axis substantially perpendicular to the central leg axis and about a second axis substantially coaxial with the central leg axis;

(c) a lower leg portion having doubly articulated means for attaching the lower leg portion to the upper leg portion, said lower leg portion being rotatable with respect to the upper leg portion about a third axis substantially perpendicular to the central leg axis and about a fourth axis substantially coaxial with the central leg axis; and (d) a foot portion having articulated means for attaching the foot portion to the lower leg portion, said foot portion being rotatable with respect to the lower leg portion about a fifth axis substantially perpendicular to the central leg axis.

The articulated means of the foot portion may be doubly articulated and the foot portion may be further rotatable with respect to the lower leg portion about a sixth axis which is substantially perpendicular to the central lower leg axis and to the fifth axis.

The invention also provides a robot head, neck and torso of a human mannequin figure, which simulate the movements of a human head, neck and torso, the robot head, neck and torso having a first common substantially central longitudinal axis and comprising, in combination:

(a) a head portion having doubly articulated means for attaching a head portion to a neck portion, the head portion being rotatable with respect to the neck portion about a second axis substantially perpendicular to the first axis and about a third axis substantially coaxial with the first central longitudinal axis;

(b) a neck portion having a spinal section, to which is attached a spinal section of a torso portion; and (c) a torso portion having a spinal section, which comprises:

(i) an upper section having doubly articulated means being rotatable about a fourth axis substantially coaxial with the first central longitudinal axis and being rotatable about a fifth axis substantially perpendicular to the first axis; and (ii) a lower section having doubly articulated means being rotatable about a sixth axis substantially coaxial with the central longitudinal axis and being rotatable about a seventh axis substantially perpendicular to the first axis.

The invention also provides an animated human mannequin figure, which simulates the movements of a human body, having a head, neck, torso, arms and legs and which comprises the articulated joints of the invention.

Preferably, a method for creating choreographs for activating the servo-articulated modules comprises:

(a) running a graphical animation program of the desired action;

(b) generating output in the program's proprietary format;

(c) transforming said output into an ASCII file format;

(d) inputting the file from step (c) together with a file having mannequin specifications into a program that transforms the choreograph instructions into a compressed binary output file for operation by a run program.

A method for operating choreographs for activating the servo-articulated modules, thereby animating a mannequin in a desired manner, comprises:

(e) inputting the compressed binary file of choreograph instructions from step (d) into a run program;

(f) the run program output being to an interface, preferably a serial interface;

(g) the interface interfacing with pulse width modulation controller circuitry;

(h) the pulse width modulation controller circuitry controlling the mannequin and causing it to execute the choreograph instructions; and (i) a power supply to supply power to the servos in the mannequin.

The invention further provides a method for creating choreographs for activating the servo-articulated modules, which comprises:

(A) using a spreadsheet program to develop a choreograph;

(B) outputting the choreograph in a spreadsheet file;

(C) transforming the spreadsheet file into an ASCII input file;

(D) inputting the file from step (C) together with a file having mannequin specifications into a program that transforms the choreograph instructions into a compressed binary output file for operation by a run program.

A method for operating choreographs created by the method described in the preceding paragraph in order to activate the servo-articulated modules, thereby animating a mannequin in a desired manner, comprises:

(E) inputting the compressed binary file of choreograph instructions from step (D) into a run program;

(F) the run program output being to an interface, preferably a serial interface;

(G) the interface interfacing with pulse width modulation controller circuitry;

(H) the pulse width modulation controller circuitry controlling the mannequin and causing it to execute the choreograph instructions; and (I) a power supply to supply power to the servos in the mannequin.

The animated mannequin of the invention comprises limbs, i.e., arms and legs, and the neck, head and torso, all of which are animated by the basic animation parts. The basic animation parts that are used to configure the mannequin of the invention are servos, servo housings, rotational connectors, straight connectors, and hinge connectors. These are described below.

Limbs and Neck, Head and Torso

Limbs may be constructed from a stick framework made of a light wood such as basswood. Other choices of materials for the framework are plastic and metal. The plastic may be either a thermoplastic or a thermoset resin and may have reinforcing fibers incorporated therein, e.g., glass, carbon, graphite, and/or boron fibers. The design objective is to achieve rigidity and strength while minimizing weight. The head, neck and torso may be similarly constructed.

Servos

Servos are readily available in the commercial hobby market today. There are several manufacturers, each with several products and features to suit different needs and applications. The choice of which servo to use in this invention is based on the degree of power, speed and strength required at each joint, and also dictated by the amount of weight that needs to be put in motion. Representative of suppliers are Futaba and Hobbico.

Servo Housings

The servo housings have been specially designed to accomplish several objectives. One is to provide a way to attach the limbs to the servos. Limbs can be attached to the servo housings by glue or by some type of screw attachment—depending upon the choice of materials. The servo housings also allow for the easy mounting of a choice of servos. The third objective of the servo housing is to allow for the rotational spline of the servos to be exposed and accessible for attachment of a hinge connector. In addition, the servo housing may provide a pivot attachment at the opposite side of the spline to aid in support of the hinge connector.

Rotational Connectors

These are modular units that mount to a limb such as a forearm. They can be mounted by glue or screws. The rotational connector has a cylindrical hole which is substantially the same size in diameter as that of the cylindrical rod component of the hinge connector. The rotational connector will freely rotate about the cylindrical rod, but will provide rigid support in all other directions. Optionally, the rotational connectors can make use of bearings to facilitate rotational motion.

Hinge Connectors

The hinge connector is designed to accomplish several objectives. It provides a connection point to a servo by way of a mount that houses a control arm. A second connection is supported by a cylindrical rod about which the rotational connector rotates and also provides an attachment point for a second control arm. The control arm comes in a variety of sizes and is a piece that typically accompanies a commercial servo. The rationale for using the control arm in the mounting capabilities in that it mates with the rotational spline of the servo. The spline connection of a servo will vary by size of servo and by manufacturer.

The hinge connection connects two (2) servos whose axis of motion are perpendicular to each other. In addition, the hinge connector will connect to the servo housing described above at the pivot attachment.

One other type of hinge connector, a straight version, used at the shoulder, wrist and ankle accomplishes a connection to a servo at one end, and a fixed connection to a limb at the other end. Another type of hinge connector, an L-shaped, or right angle version, used at the shoulder, wrist and ankle accomplishes a connection to a servo at one end, and a fixed connection to a limb at the other end straight connector.

Materials

Initially, the servo housings have been made of wood, and the hinge connectors have been made of brass. The preferred materials for these components is molded plastic of the type described above.

Graphical Animation Software

There are several software products on the market today that are tools used by graphical artists to produce animation for use and display on a computer or other media. This invention takes advantages of those tools that are used to animate a human figure (or other character). In the process of producing a two dimensional animated segment (known as rendering), certain aspects of a figure associated with position and rotation in three dimensions are managed and saved. This information is captured by this invention and translated to actual positions of the mannequin. Several of these positions can be used to develop the choreograph. One such software product used is Poser 2 by MetaCreations.

Output in Vendor's Proprietary Format

This is the three dimensional information that is produced by software such as Poser 2. The capabilities to save segments of motion are already provided by this product. This invention is only interested in the positional information related to joint rotation. Other graphical information such as that regarding surface characteristics, colors, and other information can be discarded as they do not relate to the mannequin.

Program Developed to Transform Vendor's Proprietary Data Format into ASCII Input File One program is used to interpret the output of a graphical animation package (as described above) and to translate that into the ASCII input file. The program can be implemented in a variety of languages and environments to suit the user's requirements.

Spreadsheet Program (e.g., Excel) Used to Develop Choreograph

A spreadsheet program, such as Excel, has been used to develop the information for a choreograph. This is accomplished by assigning a column for each joint and a row for each step in time. The row/column format is a very useful tool in laying out the relative positions of motion of each joint. When completed, output can be generated in a comma delimited format which can be used subsequently by the programs of the invention.

Choreograph from Spreadsheet File

This is the comma-delimited file generated by the spreadsheet program as described above. These files may be used to represent segments of motion which can be incorporated later into more complex choreographs. The method for naming and storing these segments is entirely up to the choreographer.

Program Developed to Transform Spreadsheet File into ASCII Input File

This program will read the comma delimited file generated by the spreadsheet program and translate it into the ASCII input file.

ASCII Input File

This file describes the relative rotational movements of each joint of the mannequin. Other information is also included in the file such as the speed (timing between each set of movement), the scaling factor, and the number of times to repeat each movement.

File with Mannequin Specifications

This file is used to describe the actual implementation of the mannequin. It will correlate the reference code (used by the above programs) of each of the joints of the mannequin to the actual physical port used for conveying the electrical signals. In addition, each mannequin may be implemented differently, and not all mannequins may make use of all the joints. In some implementations, only the motion of an arm may be implemented and therefore only a small number of joints may need to be programmed. Other information in this specification includes the actual physical implementation of the servos in each joint and the associated range (minimum and maximum position) of motion. In addition, information about the initial starting position or rest position is contained in the specification.

Workbench Program

This program transforms the choreograph instructions, as described above, into a compressed binary file which is used by the "Boss" program for operation of the mannequin(s). It converts the reference codes of each of the joints into the actual physical port used to send the electrical signals.

Choreograph Instruction—Binary File

This file contains information used by the Boss program to operate the mannequin. The file describes each of the relative positions of all the joints to be moved sequentially in time. It also includes information about the timing of each step, as well as the number of times to repeat segments of motion. It is designed to be a very compact file so that it will fit into a variety of implementations including the use of a PC running either DOS or Windows, a MAC or a Java program or even a programmed PIC chip that can read these instructions which could be stored on a ROM chip.

Boss Program

This program is a simple program that is designed to read a set of choreograph instructions, from the binary file described above, and write digital instructions to a device. The device can be written to via a serial interface or, alternatively, other implementations such as via a parallel interface, or a specialized card that can be installed on a motherboard in a PC. The method of access can be changed easily and is accomplished by either two (2) techniques common in the industry: writing to a port, or writing to memory.

The Boss program will read the choreograph instructions and generate output, as described above, sequentially and with the prescribed time intervals.

Serial Interface

The serial interface is usually provided at the back end of a PC. By means of a connector this can be wired to some circuitry that performs pulse width modulation.

Pulse Width Modulation (PWM) Servo Controller Circuitry

Pulse width modulation is the method used to control the position of servos. This capability has been established for a long time in the industry. Today, there are several manufacturers offering various packages to accomplish it. The current implementation uses the circuitry provided by Scott Edwards Electronics, Inc. called "Mini SSC II (Serial Servo Controller). This circuitry reads the digital output from a serial interface—connected by a phone wire—and generates the pulse width modulation signal corresponding to the designated port number which attached to the servo, and the position of the servo.

Other suppliers include Pontech, whose product, the SV203B/C Servo Motor Controller Board, provides similar capabilities.

Power Supply

Power supply to the mannequin for operation of the servos can be approximately 5–6 volts. However, other voltages or power supply configurations can be chosen based on the requirements of the servos. As an example, power can be provided by a battery pack of four (4) 1.2 volt (1.5 volt) cells, or by a 5.0–6.0 V DC converter operated by standard AC current, available from several suppliers in the market.

Mannequin with (n) Servos Choreographed in Motion

The mannequin can be configured with several servos to achieve the desired artistic expression in the choreographs. There may be commercial situations in which only a portion of the mannequin is animated such as an arm or leg. One fairly complete implementation of a mannequin is described below.

Arms

A single arm is configured with a total of seven servos. At the shoulder are three servos configured in such a way to allow motions along three axis: sideways, forward and backward, and rotating along the upper arm. At the elbow are two servos to allow motion around two axis: flexing of the arm, and rotation of the forearm. At the wrist are two servos to allow the wrist to flex in two planes.

Legs

A leg can be configured in the same way as an arm with the joints at the hip, knee and ankle.

Spine

The spine can be configured with several joints. Each joint can be configured with up to two servos giving the ability to choreograph motion in two out of three possible directions: bending forward and backward, bending sideways, or rotating. By using at least two joints in the spine, it is possible to achieve almost all positions.

Neck

The neck can be configured in the same way as the spine.

PREFERRED EMBODIMENTS OF THE INVENTION

Figure 1A:
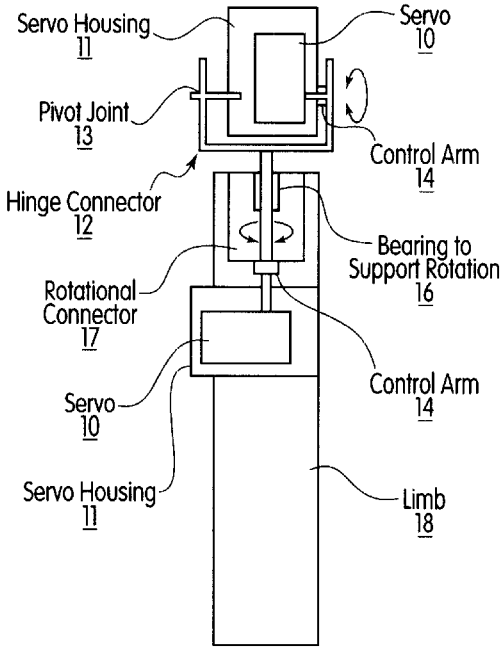
FIG. 1A illustrates a basic limb (arm or leg) assembly for a mannequin that incorporates the novel servo-articulated modules of the invention.

Wherever possible in the Figures, the same or similar elements are indicated by the same reference numerals in order to simply and clarify the following description and also to emphasize the versatility of the servo-articulated modules of the invention.

FIG. 1A illustrates a basic limb assembly. The limb shown can be either a part of an arm or a leg, and the part of the limb shown can be either an upper arm or a forearm or a thigh or a lower leg section. Servos 10, of which there are two in the limb assembly shown, activate the partial rotation of the limbs in the direction indicated by the double ended arrows. In order to cause the limb 18 to move either forward or back, i.e., either into or out of the plane of the page, the top servo 10 is activated to partially rotate control arm 14 in either direction about its common axis with pivot joint 13. The cylindrical rod 15 is attached at the bottom of hinge connector 12 and runs through bearing 16, which supports rotation in either direction as indicated by the double-ended arrow to the left of the bearing 16. Cylindrical rod 15 is connected to rotational connector 17, which in turn is connected to lower servo 10 through control arm 14. Lower servo 10 is housed in servo housing 11, and servo housing 11 is attached to limb 18. In order to cause the limb 18 to rotate about its longitudinal axis, the bottom servo 10 rotates about the control arm 14, which causes the limb 18 to rotate about the cylindrical rod 15.

Figure 1B:
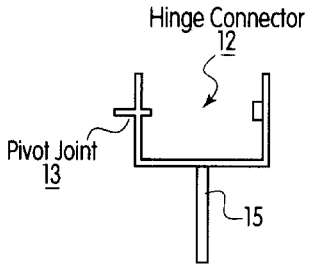
FIG. 1B is a front view of the hinge connector shown in the basic limb assembly illustrated in FIG. 1A.

FIG. 1B is a front view of the hinge connector 12 shown in the basic limb assembly illustrated in FIG. 1A. Control arm 14 is connected to the shaft of the servo 10 and causes the hinge connector 12 to rotate about its common axis with pivot joint 13 as indicated in connection with FIG. 1A. Cylindrical rod 15 is attached to the bottom of hinge connector 12.

Figure 1C:
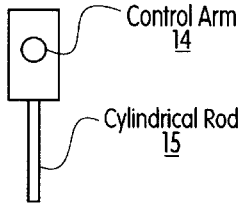
FIG. 1C is a side view of the hinge connector shown in front view in FIG. 1B.

FIG. 1C is a side view of the hinge connector shown in front view in FIG. 1B. The elements are described in connection with FIG. 1B.

Figure 1D:
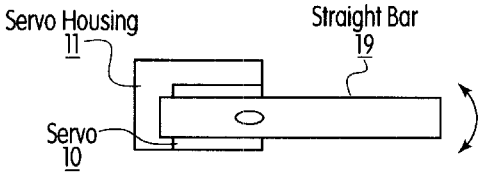
FIG. 1D is a side view of a straight connector 19 which is attached to servo 10 through control arm 14 shown in FIG. 1E, which is a top view corresponding to the side view of FIG. 1D. Depending on the weight of the limb assembly and the activity to which it will be put, it may be advisable, as indicated in FIG. 1F to extend the straight bar 19 to the left and to counterbalance the weight of the limb with a counterbalance 20.
Figure 1F:
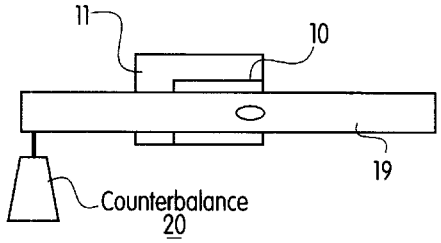
FIG. 1G shows a straight bar 19 variation in which the bar is L-shaped.
Figure 1E:
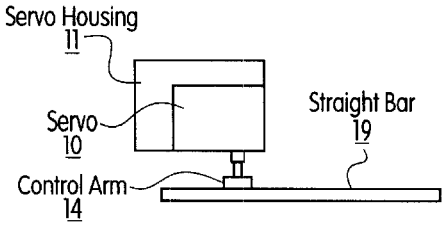

FIG. 1D is a side view of a straight bar 19 which is attached to servo 10 through control arm 14, shown in FIG. 1E, which is a top view corresponding to the side view of FIG. 1D. Servo 10 is housed in a servo housing 11. Straight bar 19 activated by the servo 10 partially rotates in the directions indicated in FIG. 1D, that is either up or down. This straight bar 19 arrangement would be useful in a shoulder joint to activate the raising of an arm outward from the body to the side. Depending on the weight of the limb assembly and the activity to which it will be put, it may be advisable, as indicated in FIG. 1F to extend the straight bar 19 to the left and to counterbalance the weight of the limb with a counterbalance 20.

Figure 1G:
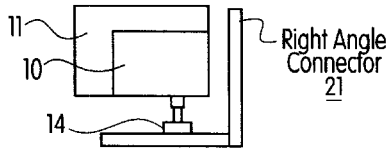

FIG. 1G shows a straight bar 19 variation in which the bar is L-shaped. Again, the servo 10 is housed in servo housing 11 and acts through control arm 14 which is attached to right angle connector 21 in order to rotate the vertical section of the right angle connector 21 either out of the paper plane or back into it. This right angle connector 21 is seen in FIGS. 2B and 3B, where it can activate the hand 30 or foot 40 respectively in a waving motion.

Figure 2A:
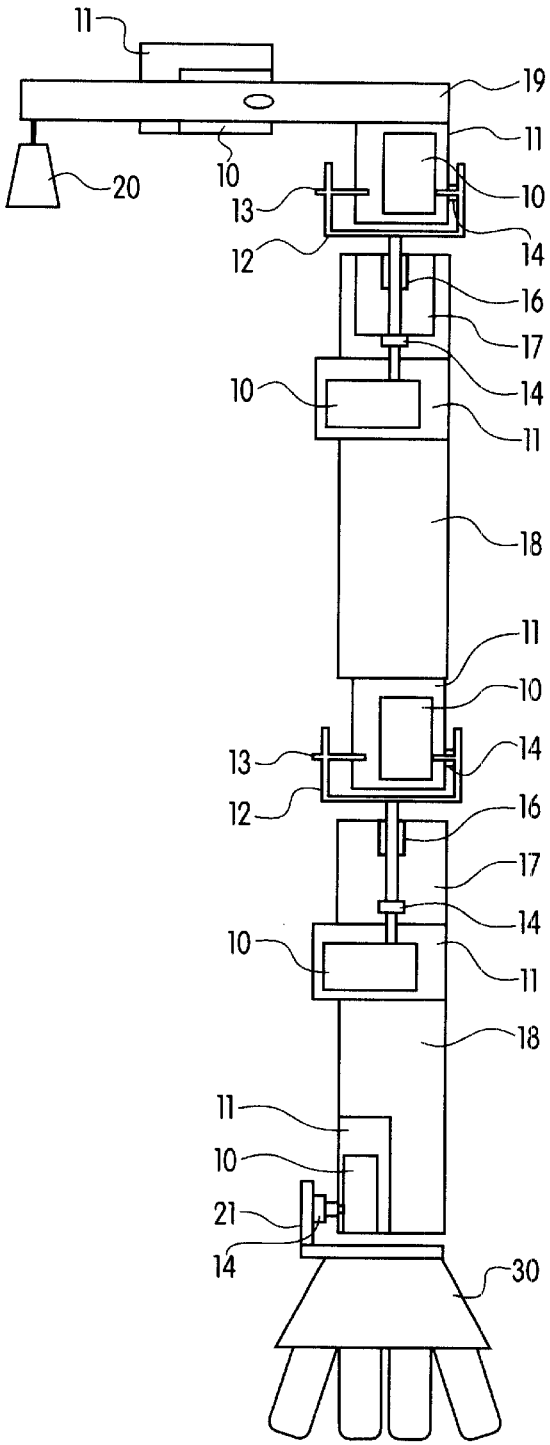
FIG. 2A illustrates an arm assembly of a mannequin that incorporates the novel servo-articulated modules of the invention.

FIG. 2A makes use of all of the elements indicated in FIGS. 1A through 1G in order to provide a complete arm assembly through the shoulder, the upper arm (the upper limb 18), the forearm (the lower limb 18) and the hand 30. These assemblies have been described in FIGS. 1A through 1G and FIG. 2A. The top servo 10 can rotate straight bar 19 in a counterclockwise direction about the area indicated by the oval at the midpoint of straight bar 19, thereby raising the arm out to the side from a torso. The top servo 10 can return the arm to a vertical position alongside a torso by rotating straight bar 19 in a clockwise direction. The arm can be caused to move upwards, either forward or back, alongside a torso by the second servo 10 from the top turning the control arm 14, thereby causing the top hinge connector 12 to pivot about the common axis of control arm 14 and pivot joint 13. Cylindrical rod 15 is attached by means of control arm 14 to the shaft of the third servo 10 from the top. Therefore, when the third servo 10 from the top is activated it turns either clockwise or counterclockwise about the common axis of cylindrical rod 15, control arm 14 and its own shaft, and while turning, it turns everything attached to it, including its servo housing 11, rotational connector 17 and bearing to support rotation 14 and everything below the third servo 10. The forearm can be caused to move upwards either forward or back alongside the torso by the fourth servo 10 from the top turning the control arm 14 to which the shaft of that servo 10 is attached, thereby causing the hinge connector 12 to which the control arm 14 is attached to pivot about the common axis of that control arm 14 and pivot joint 13. The cylindrical rod 15 of the second hinge connector 12 from the top is attached by means of a control arm 14 to the shaft of the fifth servo 10 from the top. Therefore, when the fifth servo 10 from the top is activated, it turns either clockwise or counterclockwise about the axis of cylindrical rod 15, control arm 14 and its own shaft. While turning it turns the forearm attached to it, including its servo housing 11, its rotational connector 17 and bearing to support rotation 16, and everything below the fifth servo 10. The shaft of the sixth servo 10 from the top is attached by means of the control arm 14 to right angle connector 21 in the sixth servo 10 from the top is activated. This causes the right angle connector 21 to rotate either forward or back either into or out of the plane of the page in a waving motion. The right angle connector 21 is attached to hand 30 which therefore moves either forward or back in a waving motion.

Figure 2B:
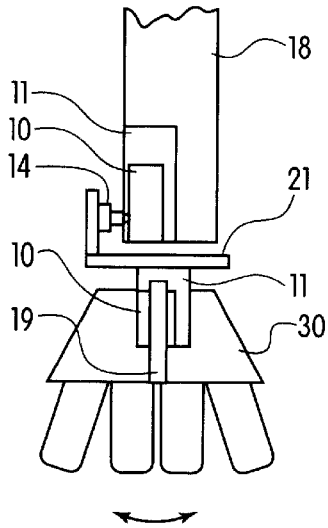
FIG. 2B is an optical hand configuration from the one shown in FIG. 2A.

FIG. 2B is an optional hand configuration from the one shown in FIG. 2A. Again, all the assemblies and the arm assembly would be as shown in FIGS. 1A through 1G and 2A. The servo 10 indicated in the hand 30 operates to rotate the hand in the directions indicated by the double ended arrow, in a handshaking motion.

Figure 3A:
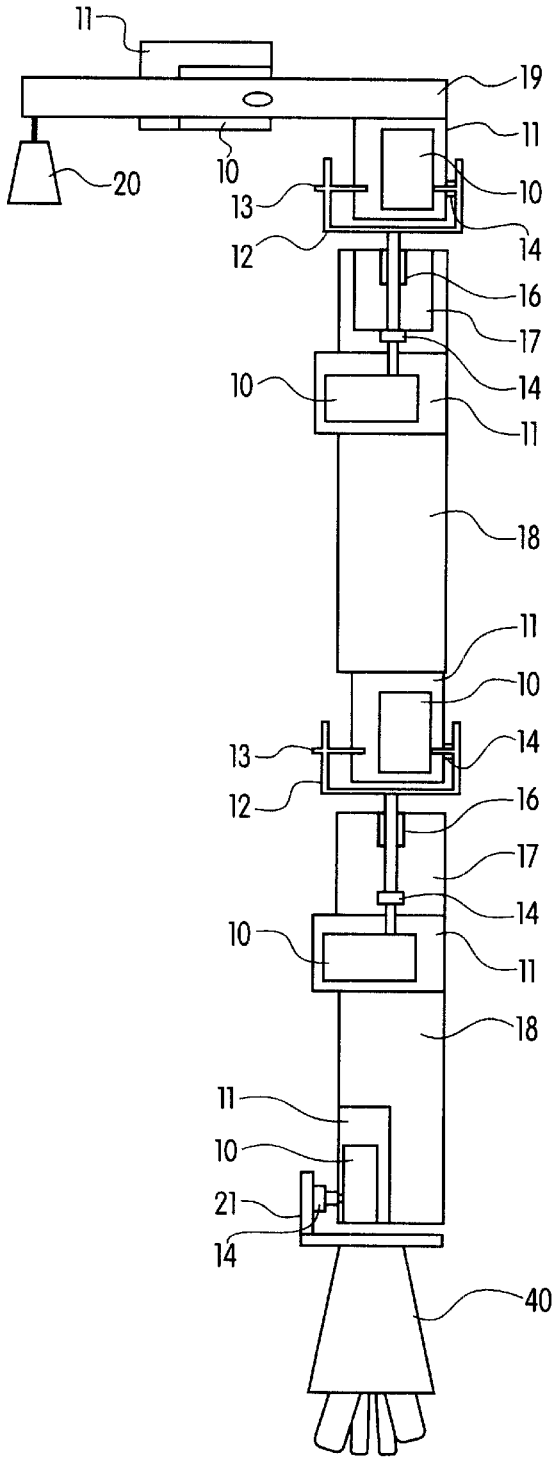
FIG. 3A illustrates a leg assembly of a mannequin that incorporates the novel servo-articulated modules of the invention.
Figure 3B:
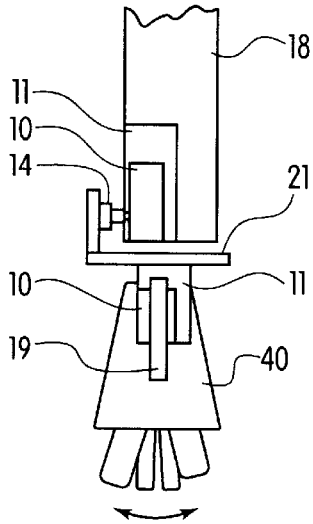
FIG. 3B illustrates an optional foot configuration tracks the similar to the hand configuration shown in FIG. 2B with the exception against that foot 40 replaces hand 30 in the former figure and in the optional foot configuration illustrated FIG. 3B

A leg assembly is illustrated in FIG. 3A, in which all numeric indicators are the same as for the hand assembly illustrated in FIG. 2A with the exception of foot 40 replacing hand 30 in the former figure.

FIG. 3A makes use of all of the elements indicated in FIGS. 1A through 1G in order to provide a complete leg assembly through the hip, the thigh (the upper limb 18), the lower leg (the lower limb 18) and the foot 40. The top servo 10 can rotate straight bar 19 in a counterclockwise direction about the area indicted by the oval at the midpoint of straight bar 19, thereby raising the leg out to the side. The top servo 10 can return the leg to a vertical position by rotating straight bar 19 in a clockwise direction. The leg can be caused to move upwards, either forward or back by the second servo 10 from the top turning the control arm 14, thereby causing the top hinge connector 12 to pivot about the common axis of control arm 14 and pivot joint 13. Cylindrical rod 15 is attached by means of control arm 14 to the shaft of the third servo 10 from the top. Therefore, when the third servo 10 from the top is activated it turns either clockwise or counterclockwise about the common axis of cylindrical rod 15, control arm 14 and its own shaft, and while turning, it turns everything attached to it, including its servo housing 11, rotational connector 17 and bearing to support rotation 14 and everything below the third servo 10. The lower leg can be caused to move upwards either forward or back by the fourth servo 10 from the top turning the control arm 14 to which the shaft of that servo 10 is attached, thereby causing the hinge connector 12 to which the control arm 14 is attached to pivot about the common axis of that control arm 14 and pivot joint 13. The cylindrical rod 15 of the second hinge connector 12 from the top is attached by means of a control arm 14 to the shaft of the fifth servo 10 from the top. Therefore, when the fifth servo 10 from the top is activated, it turns either clockwise or counterclockwise about the axis of cylindrical rod 15, control arm 14 and its own shaft. While turning, it turns the lower leg attached to it, including its servo housing 11, its rotational connector 17 and bearing to support rotation 16, and everything below the fifth servo 10. The shaft of the sixth servo 10 from the top is attached by means of the control arm 14 to right angle connector 21 in the sixth servo 10 from the top is activated. This causes the right angle connector 21 to rotate either forward or back either into or out of the plane of the page in a waving motion. The right angle connector 21 is attached to foot 40 which therefore moves either forward or back in a waving motion.

FIG. 3B illustrates an optional foot configuration which is similar to the hand configuration shown in FIG. 2B with the exception again that foot 40 replaces hand 30 in the former figure and in the optional foot configuration illustrated FIG. 3B, the servo 10 in the foot operates to rotate the foot in the directions indicated by the double ended arrows below the foot represented in the illustration.

Figure 4:
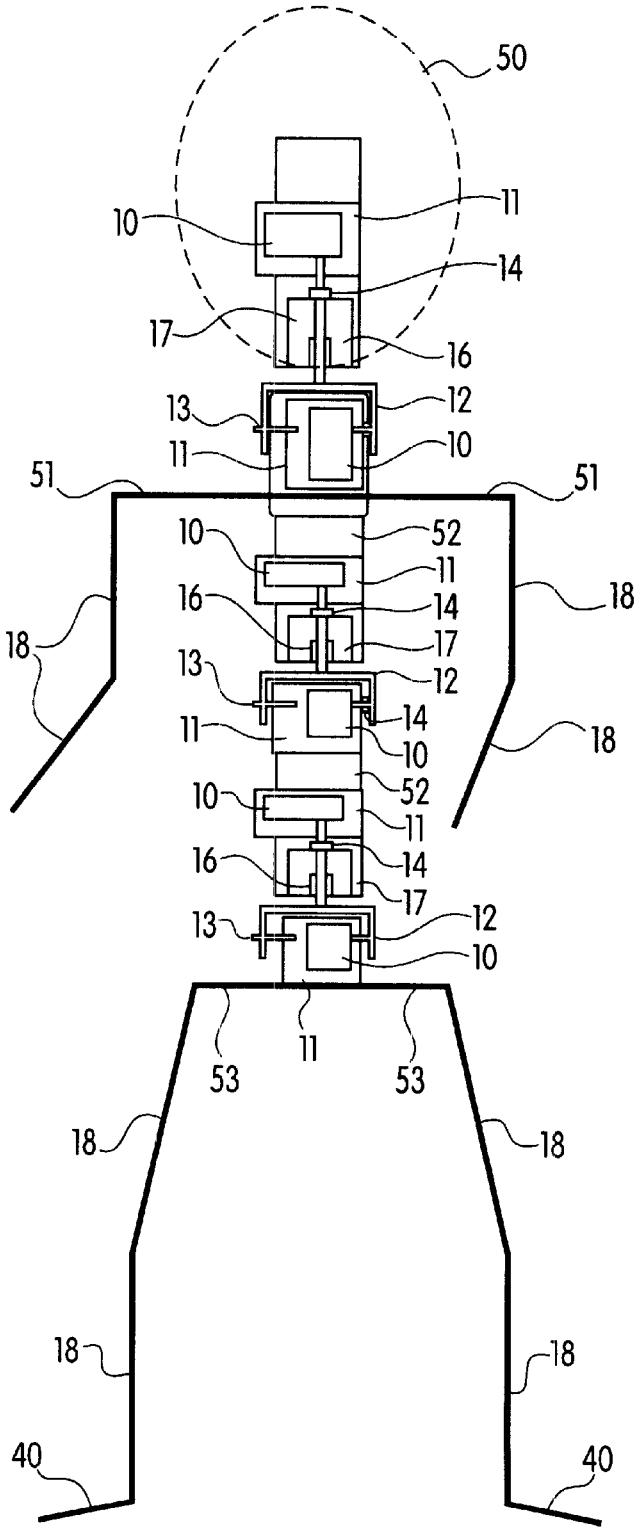
FIG. 4 illustrates a head, neck and spine assembly of a mannequin that incorporates the novel servo-articulated modules of the invention.

FIG. 4 illustrates how the basic limb assemblies shown in the earlier configurations of FIGS. 1A through 1G, 2A, 2B, 3A and 3B may be used to form the joints in the head, neck and spine of a mannequin which is otherwise represented by a stick figure. Servos 10 in the joints have been previously described in the earlier figures. Head 50 may be rotated from side to side by the topmost servo 10, which, when it is activated, causes everything attached to it to turn, i.e., head 50, the top two spinal elements 52, servo housing 11, rotational connector 17, and bearing to support rotation 16. The second servo 10 in the neck area of the mannequin functions to cause the head to nod forward and back relative to the shoulders 51. The third servo 10 in the spinal column elements 52 serves to rotate the torso about its spine. The fourth servo 10 causes the spine and therefore the torso to move forward and back. The spinal column elements 52 are equivalent to the limb sections 18. The fifth servo 10 down on the illustrated mannequin serves to rotate the lower torso about the spinal column elements 52 from side to side. The sixth servo down serves to bend the torso of the mannequin forward and back.

Figure 5:
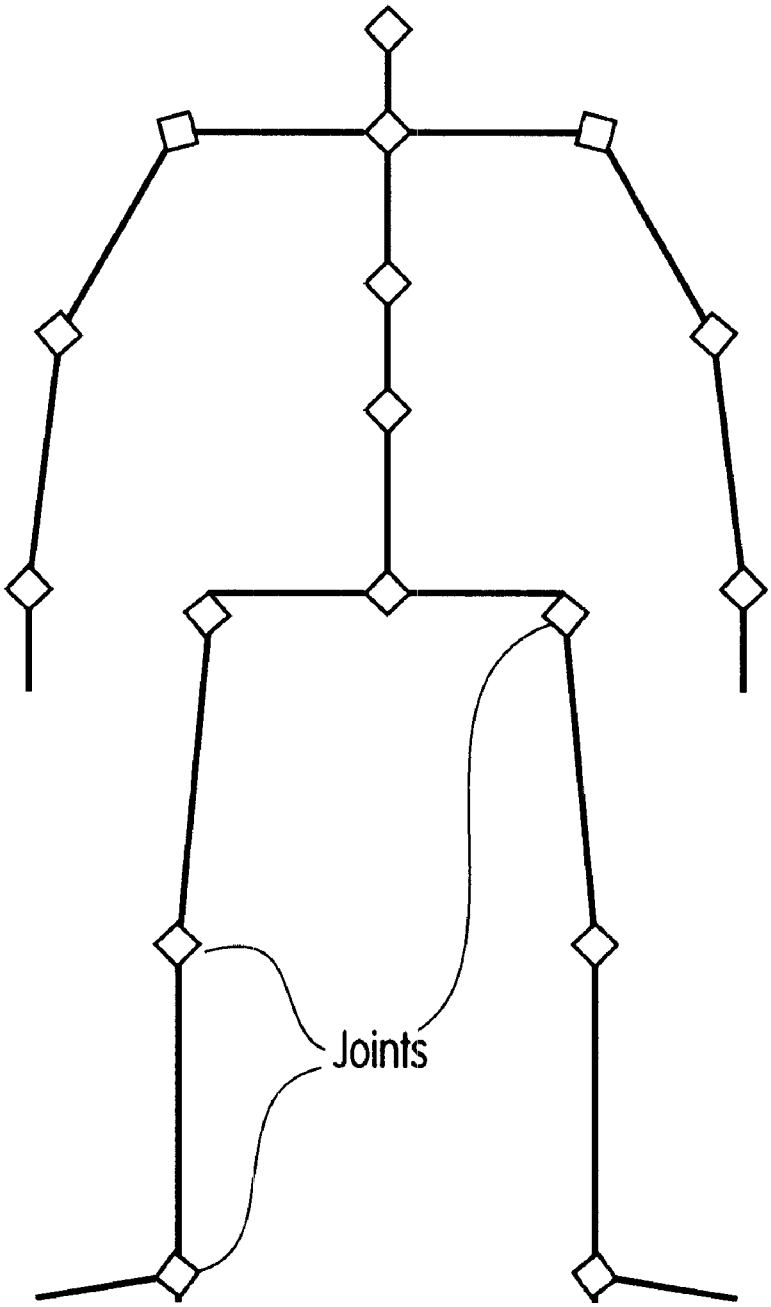
FIG. 5 illustrates a stick figure of a mannequin indicating the incorporation of the novel servo-articulated modules of the invention by the diamond symbols at their location.

FIG. 5 is a stick figure of a mannequin in which the diamonds each indicate a joint or a doubly articulated joint of the invention.

Figure 6:
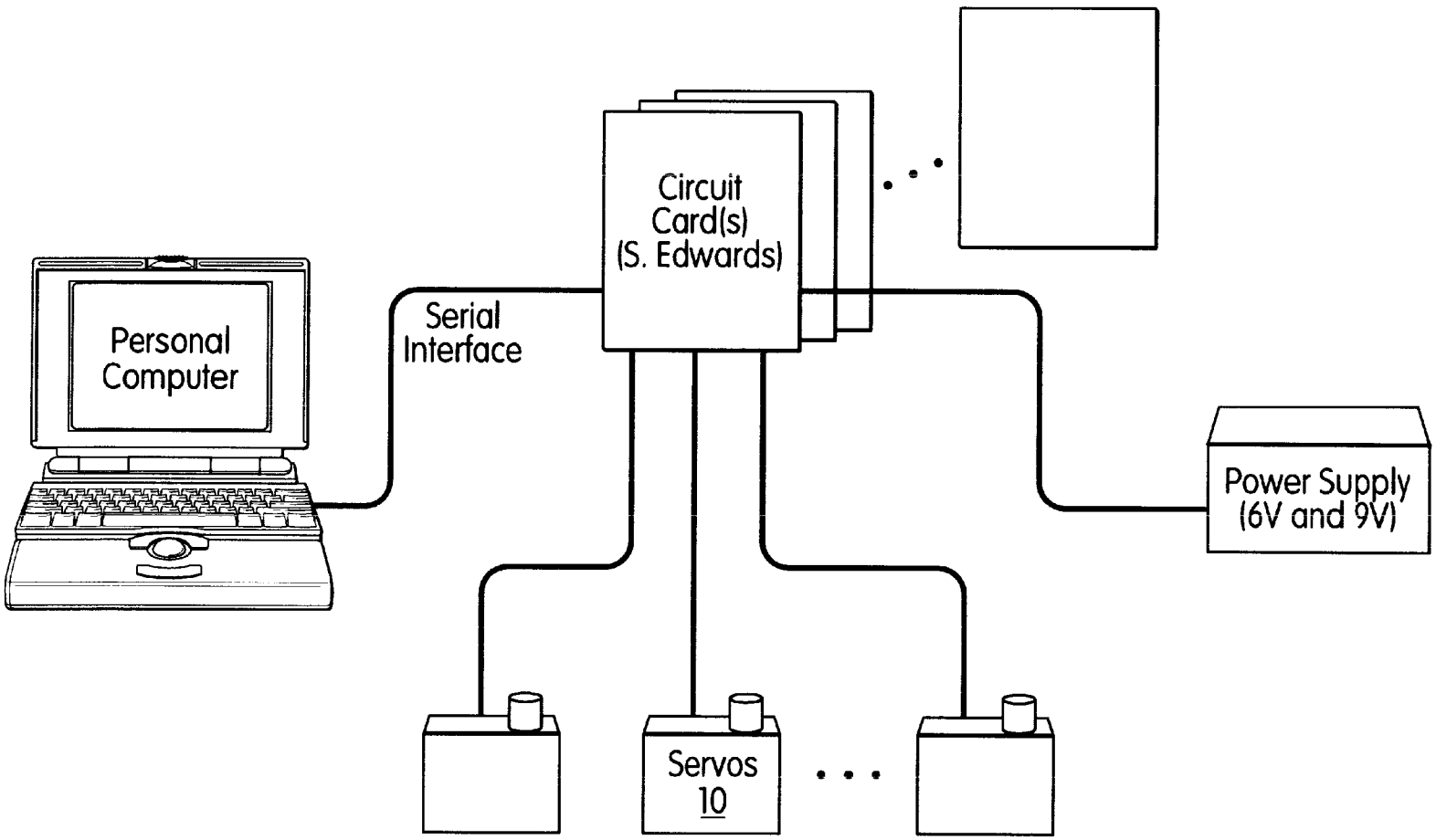
FIG. 6 illustrates a circuit layout that incorporates the novel servo-articulated modules of the invention that may be achieved by the circuitry shown in the layout depicted in FIG. 6.

FIG. 6 gives the circuit layout in which programming is done on a personal computer 50 which controls circuit card(s) 51 attached to and in turn controlling servos 10. These circuit cards may be provided by any convenient supplier. A preferred supplier is S. Edwards. A power supply 52 provides 6 volts to the servos 10 and 9 volts to the circuit cards 51.

Figure 7:
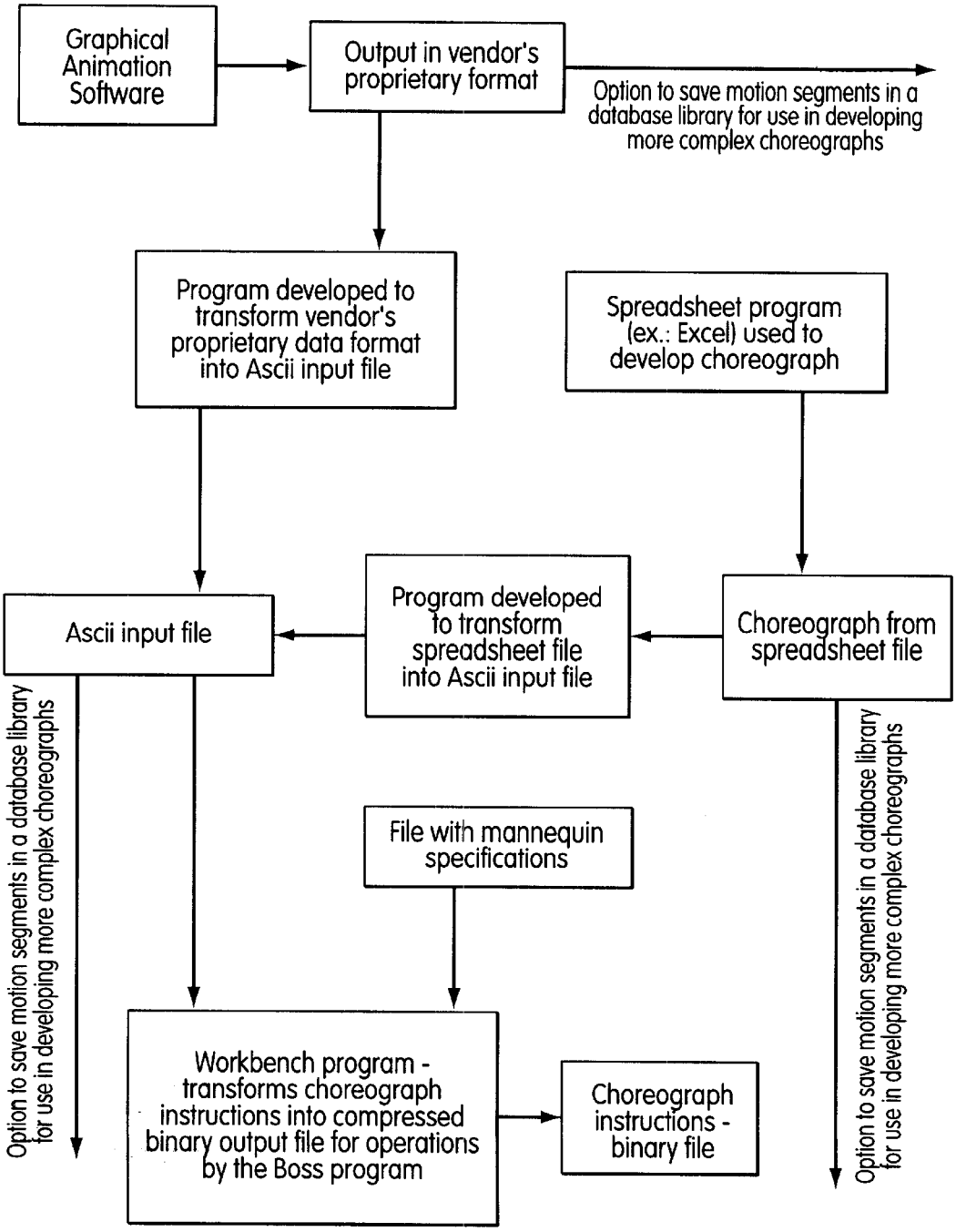
FIG. 7 is a functional flow chart of a method for creating choreographs for a mannequin that incorporates the novel servo-articulated modules of the invention.

FIG. 7 shows a functional flowchart for creating choreographs. The output from commercially available graphical animation software may be input into a program which transforms the vendor's proprietary data format into an ASCII input file. (Optionally, the output of the graphic animation software program may instead be saved in motion segments in a data base library for use in developing more complex choreographs.) The ASCII input file and a file with mannequin specifications may then be input to a workbench program which transforms the choreographic instructions into a compressed binary output file for operations by the BOSS program.

An alternative functional flow for creating choreographs is also indicated in FIG. 7, i.e., the use of the spreadsheet program, e.g., EXCEL to develop a choreograph which then gets input into a program developed to transform a spreadsheet file into an ASCII input file, which then follows the functional flow chart as described above. Optionally the motion segments from the choreographic spreadsheet file may be saved in a database library for use in developing more complex choreographs.

ASCII Input File Specifications

This file is a sequential comma delimited file used to describe a choreograph. It consists of two types of records: a header record and a movement record.

The header record is structured as follows:

timer, laststep, repeat, scale

Where:

Timer is an integer value that indicates in a relative fashion how fast this choreograph should be performed. For example, a value of 200 would tell the system to operate this choreograph twice as fast as if a value of 100 were used. The purpose of this value is to give the choreographer the ability to adjust the tempo.

Laststep—this value represents the number of sequential steps in the choreograph. It is a value that does not have to be included in this file because the system will calculate it.

Repeat—This is an integer value that tells the system how many times to play the choreograph.

Scale—This is an integer value that is used to indicate how many increments or steps are used in the choreographs to define the positions of the servos. For example, if the scale were 10, then the numbers from 0 to 10 will be used in the choreograph to indicate the servo positions where 0 would represent the minimum position and 10 would represent the maximum position. The system uses the scaled numbers to calculate the actual desired servo position given the physical characteristics of each servo as specified in the mannequin file.

The movement record is structured as follows:

step, joint position

Step—This is an integer that numbers the step of a particular joints' next position. The step represents a position in a sequential series of equal time intervals. There can be directions to move several joints for each step. Also, there does not have to be a movement for each step.

Joint—This represents the particular joint that is to be moved. In this case, a three (3) character convention is used to represent each joint as described in the mannequin file.

Position—This is an integer number that represents the relative position of movement for a servo. The position must correspond to the scale that is used and described in the header record. For example, if the scale is 100, then the position should be a number between 0 and 100.

Below is an example of an ASCII input file used to describe a handshake.

200,0,1.100
1,"LW1",50
1,"LS1",50
1,"LS2",50
1,"LS3",50
2,"LE1",5
3,"LE1",10
3,"LE2",5
4,"LE1",15
5,"LE1",20
5,"LE2",10
5,"LS1",60
5,"LS2",60
5,"LS3",60
6,"LE1",25
7,"LE1",30
7,"LE2",15
8,"LE1",35
9,"LE1",40
9,"LE2",20
9,"LS1",70
9,"LS2",70
9,"LS3",70
10,"LE1",45
11,"LE1",50
11,"LE2",25
12,"LE1",55
13,"LE1",60
13,"LE2",30
13,"LS2",80
14,"LE1",65
15,"LE1",70
15,"LE2",35
16,"LE1",75
17,"LE1",80
17,"LE2",40
17,"LS2",90
18,"LE1",85
19,"LE1",90
19,"LE2",45
20,"LE1",95
21,"LE1",95
21,"LE2",50
21,"LS2",95
22,"LE1",90
23,"LE1",85
24,"LE1",80
25,"LE1",75
26,"LE1",70
27,"LE1",65
28,"LE1",60
29,"LE1",55
30,"LE1",50
31,"LE1",45
32,"LE1",50
33,"LE1",55
34,"LE1",60
35,"LE1",65
36,"LE1",70
37,"LE1",75
38,"LE1",80
39,"LE1",85[1]
40,"LE1",90
41,"LE1",85
42,"LE1",80
43,"LE1",75
44,"LE1",70
45,"LE1",65
46,"LE1",60
47,"LE1",55
48,"LE1",60
49,"LE1",65
50,"LE1",70
51,"LE1",75
52,"LE1",80
53,"LE1",85
54,"LE1",90
55,"LE1",85
56,"LE1",80
57,"LE1",75
58,"LE1",70
59,"LE1",65
60,"LE1",60

Mannequin File Specifications

This file is used to describe the characteristics of how a mannequin is physically configured. The file is a sequential ASCII file where each record has the following comma delimited record format:

port, joint, min, max, reversed, rest

Where:

Port—specifies the actual physical port used. Typically, this would be an integer number in the range of 0–63, or even higher, and depends upon the convention used by the servo controller circuitry. The port is an address that specifies the location where the wires from a particular servo are attached.

Joint—this is the reference to the identification of the joint in a choreograph. For this implementation a 3 character convention is used to identify each joint. As an example:

LS1 is the first joint of the left shoulder
LS2 is the second joint of the left shoulder
LS3 is the third joint of the left shoulder
LE1 is the first joint of the left elbow
LE2 is the second joint of the left elbow
LW1 is the first joint of the left wrist Min—specifies an integer number between 0 and 255 the position that is the minimum position, or end of travel positions, of a particular servo.

Max—specifies as an integer number between 0 and 255 the position that is the maximum position, or end of travel position, of a particular servo.

Reversed—this is an integer number with a value of either 0 or 1. If 1, it tells the system that a particular servo is reversed which means that its minimum and maximum positions are opposite to the convention adopted.

Rest—this is an integer number with a value between 0 and 255 and specifies the rest position, or neutral position of a particular servo. This gives to the programs the capability of re-setting the mannequin to the rest position after each choreograph is performed.

An example of a simple mannequin file is below:

2,LE1,20,160,0,20
1,LE2,20,240,0,240
0,LW1,30,240,0,140

5,LS1,80,160,0,130
4,LS2,50,170,0,120
3,LS3,0,220,0,130

Figure 8:
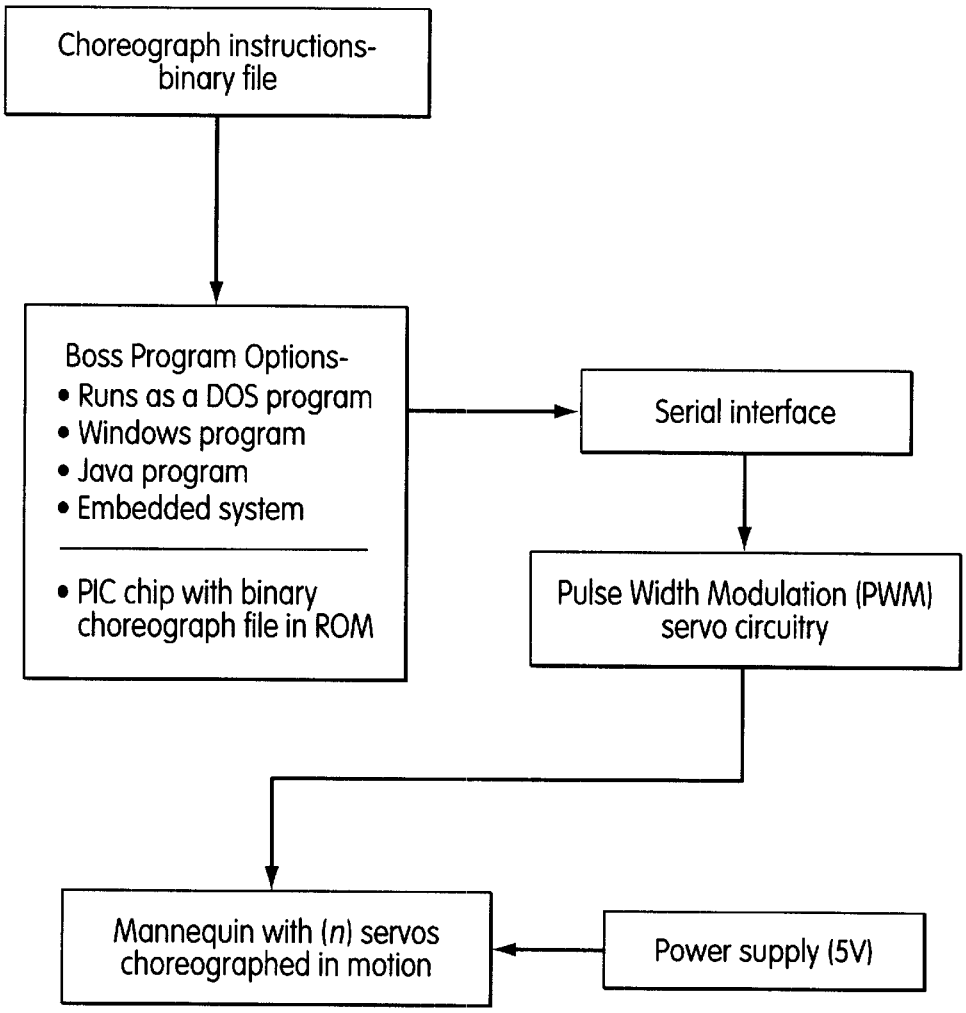
FIG. 8 is a flow chart of the operations of actual choreographs of a mannequin that incorporates the novel servo-articulated modules of the invention.

The choreographic instructions binary file shown in FIG. 7 may be used as indicated in FIG. 8 as the input to the BOSS program which has a number of options. It can run as a DOS program, as a Windows program, as a MAC program as a JAVA program or may be an embedded system. An alternative approach is to use a PIC chip with the binary choreographic file in ROM. In the first four options, the output via a serial interface may be input into pulse width modulation (PWM) servo controller circuitry, which then animates the mannequin by moving any of the servos choreographed in motion. The servos can be operated with 5 volts or for better response 6 volts. Alternatively, the output of the PIC chip may be input into the PWM servo controller circuitry to animate the mannequin as indicated.

Tables 1 and 2 hereinafter illustrate two simple choreographs developed by use of the spreadsheet approach. In Table 1, a choreograph is given for a handshake by the mannequin. Table 2 gives the spreadsheet choreograph instructions for a basketball dribbling motion by the mannequin.

Handshake

| itimer | laststep | repeat | scale | temp | temp | temp |
|---|---|---|---|---|---|---|
| 200 | 0 | 1 | 100 | 0 | 0 | 0 |
| step | LEI | LE2 | LWI | LS1 | LS2 | LS3 |
| 1 | 0 | 0 | 50 | 50 | 50 | 50 |
| 2 | 5 | | | 0 | 0 | 0 |
| 3 | 10 | 5 | | 0 | 0 | 0 |
| 4 | 15 | | | 0 | 0 | 0 |
| 5 | 20 | 10 | | 60 | 60 | 60 |
| 6 | 25 | | | 0 | 0 | 0 |
| 7 | 30 | 15 | | 0 | 0 | 0 |
| 8 | 35 | | | 0 | 0 | 0 |
| 9 | 40 | 20 | | 70 | 70 | 70 |
| 10 | 45 | | | 0 | 0 | 0 |
| 11 | 50 | 25 | | 0 | 0 | 0 |
| 12 | 55 | | | 0 | 0 | 0 |
| 13 | 60 | 30 | | 0 | 80 | 0 |
| 14 | 65 | | | 0 | 0 | 0 |
| 15 | 70 | 35 | | 0 | 0 | 0 |
| 16 | 75 | | | 0 | 0 | 0 |
| 17 | 80 | 40 | | 0 | 90 | 0 |
| 18 | 85 | | | 0 | 0 | 0 |
| 19 | 90 | 45 | | 0 | 0 | 0 |
| 20 | 95 | | | 0 | 0 | 0 |
| 21 | 95 | 50 | | 0 | 95 | 0 |
| 22 | 90 | | | 0 | 0 | 0 |
| 23 | 85 | | | 0 | 0 | 0 |
| 24 | 80 | | | 0 | 0 | 0 |
| 25 | 75 | | | 0 | 0 | 0 |
| 26 | 70 | | | 0 | 0 | 0 |
| 27 | 65 | | | 0 | 0 | 0 |
| 28 | 60 | | | 0 | 0 | 0 |
| 29 | 55 | | | 0 | 0 | 0 |
| 30 | 50 | | | 0 | 0 | 0 |
| 31 | 45 | | | 0 | 0 | 0 |
| 32 | 50 | | | 0 | 0 | 0 |
| 33 | 55 | | | 0 | 0 | 0 |
| 34 | 60 | | | 0 | 0 | 0 |
| 35 | 65 | | | 0 | 0 | 0 |
| 36 | 70 | | | 0 | 0 | 0 |
| 37 | 75 | | | 0 | 0 | 0 |
| 38 | 80 | | | 0 | 0 | 0 |
| 39 | 85 | | | 0 | 0 | 0 |
| 40 | 90 | | | 0 | 0 | 0 |
| 41 | 85 | | | 0 | 0 | 0 |
| 42 | 80 | | | 0 | 0 | 0 |
| 43 | 75 | | | 0 | 0 | 0 |
| 44 | 65 | | | 0 | 0 | 0 |

-continued

Handshake

| itimer | laststep | repeat | scale | temp | temp | temp |
|---|---|---|---|---|---|---|
| 45 | 55 | | | 0 | 0 | 0 |
| 46 | 60 | | | 0 | 0 | 0 |
| 47 | 55 | | | 0 | 0 | 0 |
| 48 | 60 | | | 0 | 0 | 0 |
| 49 | 65 | | | 0 | 0 | 0 |
| 50 | 70 | | | 0 | 0 | 0 |
| 51 | 75 | | | 0 | 0 | 0 |
| 52 | 80 | | | 0 | 0 | 0 |
| 53 | 85 | | | 0 | 0 | 0 |
| 54 | 90 | | | 0 | 0 | 0 |
| 55 | 85 | | | 0 | 0 | 0 |
| 56 | 80 | | | 0 | 0 | 0 |
| 57 | 75 | | | 0 | 0 | 0 |
| 58 | 70 | | | 0 | 0 | 0 |
| 59 | 65 | | | 0 | 0 | 0 |
| 60 | 60 | | | 0 | 0 | 0 |

Dribble

| itimer | laststep | repeat | scale | temp | temp | temp |
|---|---|---|---|---|---|---|
| 200 | 0 | 1 | 100 | 0 | 0 | 0 |
| step | LE1 | LE2 | LW1 | LS1 | LS2 | LS3 |
| 1 | 0 | 100 | 50 | 50 | 50 | 50 |
| 2 | 5 | | | 0 | 0 | 0 |
| 3 | 10 | | | 0 | 55 | 0 |
| 4 | 15 | | | 0 | 0 | 0 |
| 5 | 20 | | | 0 | 60 | 0 |
| 6 | 25 | | | 0 | 0 | 0 |
| 7 | 30 | | | 0 | 65 | 0 |
| 8 | 35 | | | 0 | 0 | 0 |
| 9 | 40 | | | 0 | 70 | 0 |
| 10 | 45 | | | 0 | 0 | 0 |
| 11 | 50 | | | 0 | 75 | 0 |
| 12 | 55 | | | 0 | 0 | 0 |
| 13 | 60 | | | 0 | 80 | 0 |
| 14 | 65 | | 40 | 0 | 0 | 0 |
| 15 | 70 | | | 0 | 85 | 0 |
| 16 | 75 | | 30 | 0 | 0 | 0 |
| 17 | 80 | | | 0 | 0 | 90 |
| 18 | 85 | | | 0 | 0 | 0 |
| 19 | 90 | | 40 | 0 | 0 | 45 |
| 20 | 80 | | | 0 | 0 | 0 |
| 21 | 70 | | 50 | 0 | 0 | 0 |
| 22 | 60 | | 60 | 0 | 80 | 40 |
| 23 | 70 | | 50 | 0 | 70 | 0 |
| 24 | 80 | | 40 | 0 | 60 | 0 |
| 25 | 90 | | 30 | 0 | 70 | 35 |
| 26 | 80 | | 40 | 0 | 80 | 0 |
| 27 | 70 | | 50 | 0 | 90 | 0 |
| 28 | 60 | | 60 | 0 | 80 | 30 |
| 29 | 70 | | 50 | 0 | 70 | 0 |
| 30 | 80 | | 40 | 0 | 60 | 0 |
| 31 | 90 | | 30 | 0 | 70 | 35 |
| 32 | 80 | | 40 | 0 | 80 | 0 |
| 33 | 70 | | 50 | 0 | 90 | 0 |
| 34 | 60 | | 60 | 0 | 80 | 40 |
| 35 | 70 | | 50 | 0 | 70 | 0 |
| 36 | 80 | | 40 | 0 | 60 | 0 |
| 37 | 90 | | 30 | 0 | 70 | 45 |
| 38 | 80 | | 40 | 0 | 80 | 0 |
| 39 | 70 | | 50 | 0 | 90 | 0 |
| 40 | 60 | | 60 | 0 | 80 | 50 |
| 41 | 70 | | 50 | 0 | 70 | 0 |
| 42 | 80 | | 40 | 0 | 60 | 0 |
| 43 | 90 | | 30 | 0 | 70 | 55 |
| 44 | 80 | | 40 | 0 | 80 | 0 |
| 45 | 70 | | 50 | 0 | 90 | 0 |
| 46 | 60 | | 60 | 0 | 80 | 50 |
| 47 | 70 | | 50 | 0 | 70 | 0 |

-continued

| Dribble | | | | | | |
|---|---|---|---|---|---|---|
| itimer | laststep | repeat | scale | temp | temp | temp |
| 48 | 80 | | 40 | 0 | 60 | 0 |
| 49 | 90 | | 30 | 0 | 70 | 45 |
| 50 | 80 | | 40 | 0 | 80 | 0 |
| 51 | 70 | | 50 | 0 | 90 | 0 |
| 52 | 60 | | 60 | 0 | 80 | 40 |
| 53 | 70 | | 50 | 0 | 70 | 0 |
| 54 | 80 | | 40 | 0 | 60 | 0 |
| 55 | 90 | | 30 | 0 | 70 | 35 |
| 56 | 80 | | 40 | 0 | 80 | 0 |
| 57 | 70 | | 50 | 0 | 90 | 0 |
| 58 | 60 | | 60 | 0 | 80 | 30 |
| 59 | 70 | | 50 | 0 | 70 | 0 |
| 60 | 60 | | 40 | 0 | 60 | 0 |

The foregoing specification and drawings have thus described and illustrated improved servo-articulated modules and robotic assemblies incorporating them, particularly mannequins used for displays and demonstrations, which fulfill all the objects and advantages sought therefor. Many changes, modifications, variations and other uses and applications of the subject invention will, however, become apparent to those skilled in the art after considering this specification which discloses the preferred embodiments thereof. All such changes, modifications, variations and other uses and applications which do not depart from the spirit and scope of the invention are deemed to be covered by the invention, which is to be limited only by the claims which follow.

What is claimed is:

1. A method for creating choreographs for animating a mannequin, said method comprising the steps of:

(a) running a graphical animation program of the desired action;

(b) generating output in the program's proprietary format;

(c) transforming said output into a standard ASCII file format; and (d) inputting the combined files from step (c) together with a file having mannequin specifications into a program that transforms the choreograph instructions into a compressed binary output file for operation by a run program.

2. A method for creating choreographs as created in accordance with claim 1, thereby animating the mannequin in a desired manner, which comprises:

(a) inputting the compressed binary file of choreograph instructions from step (d) in claim 1 into a run program;

(b) the run program output being to an interface;

(c) the interface interfacing with pulse width modulation controller circuitry;

(d) the pulse width modulation controller circuitry controlling the mannequin and causing it to execute the choreograph instruction; and (e) a power supply to supply power to the mannequin.

3. A method for creating choreographs as created in accordance with claim 2, thereby animating the mannequin in a desired manner, in which the interface is a serial interface.

4. A method for creating choreographs for animating a mannequin, said method comprising the steps of:

(a) using a spreadsheet program to develop a choreograph;

(b) outputting the choreograph in a spreadsheet file;

(c) transforming the spreadsheet file into an ASCII input file;

(d) inputting the file from step (c) together with a file having mannequin specifications into a program that transforms the choreograph instructions into a compressed binary output file for operation by a run program.

5. A method for creating choreographs as created in accordance with claim 4, thereby animating the mannequin in a desired manner, which comprises:

(a) inputting the compressed binary file of choreograph instructions from step (d) in claim 4 into a run program;

(b) the run program output being to an interface;

(c) the interface interfacing with pulse width modulation controller circuitry;

(d) the pulse width modulation controller circuitry controlling the mannequin and causing it to execute the choreograph instructions; and (e) a power supply to supply power to the mannequin.

6. A method for creating choreographs as created in accordance with claim 5, thereby animating the mannequin in a desired manner, in which the interface is a serial interface.

* * * * *